United States Patent [19]

Gillespie et al.

[11] Patent Number: 4,676,277

[45] Date of Patent: Jun. 30, 1987

[54] VACUUM CLEANING SYSTEM FOR THE AUTOMATIC INSERTION AREA OF A WEAVING MACHINE

[75] Inventors: David A. Gillespie, Moore; Gary R. Harrell, Spartanburg, both of S.C.; Wladyslaw Typrowicz, Westford, Mass.

[73] Assignee: Abington, Inc., North Abington, Mass.

[21] Appl. No.: 853,435

[22] Filed: Apr. 18, 1986

[51] Int. Cl.[4] ..... D03D 49/00

[52] U.S. Cl. ..... 139/1 C; 15/301

[58] Field of Search ..... 139/1 R, 1 C; 242/35.5 R; 15/301, 306 A

[56] References Cited

U.S. PATENT DOCUMENTS

| | | | |
|---|---|---|---|
| 2,976,668 | 3/1961 | Reiterer | 15/301 |
| 2,979,754 | 4/1961 | Harris | 15/301 |
| 3,311,135 | 3/1967 | Maguire et al. | 139/1 C |
| 3,491,801 | 1/1970 | Lippuner | 139/1 C |
| 3,986,328 | 10/1976 | Harrap | 139/1 C |
| 4,546,799 | 10/1985 | Riesen | 139/1 C |

*Primary Examiner*—Henry S. Jaudon
*Attorney, Agent, or Firm*—Cort Flint

[57] ABSTRACT

A vacuum cleaning system is disclosed for cleaning the automatic insertion area of a loom. In a typical weaving operation, there are a number of successive rows of individual looms (11). In accordance with the present invention, there is a main vacuum line (28) routed transverse to the rows of looms and secondary vacuum lines (26) extending along the rows of looms. Electropneumatic valves (29) are provided to selectively connect and disconnect the individual secondary lines so that an intermittent vacuum may be placed on the looms of successive rows in a cyclic manner. The vacuum cleaning system includes a vacuum manifold (46) connected by a branch line (40) to a secondary vacuum line (26). A balancing valve (42) is included in each branch line (40) to balance the vacuum at each loom so that generally equal vacuum is applied to the looms along the row. A number of individual, directional lines (A, 72, 74, 76, ) are connected to manifold (46). The directional loom vacuum lines are flexible and may be moved to a desired location with the free ends of the directional lines unsupported. In this manner the directional lines may be flexed to and away from the vacuum location while rigidly set at the location. A primary loom vacuum line (80) is directed to a mechanical weft inserting device which inserts the weft thread into a projectile (71). The flexible, directional lines (72, 74, 76) are positioned at various thread guides and thread tensioning guides in the automatic weft insertion area to vacuum the loose fly created by the friction of the weft thread passing through the guides.

24 Claims, 5 Drawing Figures

Fig. 1-A.

VACUUM CLEANING SYSTEM FOR THE AUTOMATIC INSERTION AREA OF A WEAVING MACHINE

BACKGROUND OF THE INVENTION

This invention relates to the automatic cleaning by vacuum of locations in the automatic weft insertion area of a loom, in particular, to those types of looms that are commonly referred to as shuttle-less looms or weaving machines.

In the process of weaving, the filling thread or weft must be inserted through the warp threads. This can be accomplished in many different methods. Filling thread can be inserted by shuttle, projectile, or other methods. Recent developments use waterjets or airjets to power the insertion devices.

In all these methods the action of inserting the weft or filling thread causes a great deal of friction on the thread as it passes through various thread tensioning devices and thread guides prior to reaching the automatic insertion device. This friction creates a hostile environment and causes a lot of fly or loose fibers to be generated in the insertion area. Also, at the insertion device the normal lubrication system creates a heavy oily mist. The loose fly and the oily mist combine to produce an oily loose fly that causes many problems.

Most importantly, when the oily loose fly settles on the insertion device, thread guides, tension guides, and thread, it is sometimes woven into the fabric causing defects known as oil spots or filling spots.

Heretofore, it has been a common practice to use compressed air to blow off this insertion area with the loom stopped and sometimes with the loom running. This solution causes as many problems as it is designed to solve, by blowing the oily fly into the already woven fabric, thus causing defects.

U.S. Pat. No. 4,546,799 discloses a device for cleaning the weft insertion area of a loom which utilizes air blown over the parts desired to be cleaned. Other patents which are typical of the art, wherein air or compressed air is blown on the parts to be cleaned, include U.S. Pat. Nos. 4,315,529, 4,230,158, and 3,491,801.

U.S. Pat. No. 2,812,251 shows an automatic system for removing lint from textile looms by blowing air in a cyclic manner.

U.S. Pat. Nos. 3,604,466 and 2,984,263 disclose various devices for cleaning parts of a loom by vacuum.

Accordingly, an object of the present invention is to provide a vacuum cleaning system for the automatic insertion area of weaving machines which cleans and removes fly or loose fibers generated in the weft insertion area, thus reducing the problems occasioned by loose fly and oily mist heretofore experienced.

Still another object of the invention is to provide a vacuum cleaning system for the automatic insertion area of weaving machines which utilizes a minimum amount of energy yet provides a balanced cleaning of a number of weaving machines at one time.

Still another object of the invention is to provide a vacuum cleaning system for the automatic insertion area of weaving machines which is simple, energy efficient, and may be readily moved out of the way for working on the parts being cleaned.

SUMMARY OF THE INVENTION

The above objects are accomplished according to the present invention by a system and method of vacuum cleaning of the problematic parts of the automatic insertion area of the weaving machine. The system includes a header vacuum line interconnecting at least one row of weaving machines with a branch line going from the vacuum line to each weaving machine. In the branch line a balancing valve is connected for balancing the vacuum applied to the number of looms in the row. A manifold is attached to the loom which is connected to the balancing valve. A number of individual loom vacuum lines are connected to the manifold. A number of the loom vacuum lines are directed to the thread guides and thread tensioning guides through which the filling thread passes on the way to the automatic insertion device. It is in this area that a considerable amount of friction is built up creating the problematic loose fly fibers. Individual loom vacuum lines are directed to the exact locations of thread guides and the thread tension guides. In this manner, the vacuum may be concentrated at the location where it is needed most. Secondly, a primary loom vacuum line is directed to the mechanical insertion device for cleaning the location where the filling thread is gripped by the projectile or other insertion device. The loom vacuum lines are preferably provided by flexible directional vacuum lines which are deformable and movable, yet remain fixed in place once deformed and moved to a desired position at a cleaning location. In this manner the exact position for the vacuum nozzle may be fixed over the part to be cleaned but at the same time the vacuum nozzle may be moved easily out of the way for servicing the part. The primary vacuum line nozzle is affixed to the automatic insertion device for vacuum cleaning of the projectile gripping area. In this area the filling thread is grasped by a projectile which is oiled and a lot of the oily mist occurs. The fly or loose fibers created by the previous friction of the thread is brought into this area and combined with the oily mist to cause most of the problems. Therefore, the primary loom vacuum line is provided with a larger flow to remove the accumulated oily mist or fly.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1A is a schematic view of a main vacuum line and secondary vacuum line for vacuum cleaning of looms in accordance with the present invention;

DESCRIPTION OF A PREFERRED EMBODIMENT

The invention relates to vacuum cleaning of the automatic weft insertion area of a loom. On a larger scale, the invention relates to the automatic cleaning of a number of looms, several hundred, in a given weave room installation by vacuum cleaning.

It has been found necessary to apply the much stronger vacuum of a multistage exhauster than the vacuum provided by a fan. This would be seventy to one hundred twenty inches of water for the exhauster against one to five inches of water for the fan. To cover an entire weave room with several hundred looms, continuously, central vacuum would require a very large volume of air and consequently an uneconomic amount of horsepower. According to the invention, vacuum is applied to the critical weft insertion areas for approximately three to ten seconds at two to ten minute intervals. Vacuum nozzles on fourteen to sixteen looms are connected to a secondary vacuum line with an electropneumatic valve which is connected to a main vacuum line. In this way there are groups of fourteen to sixteen looms, each with an electropneumatic valve, connected to the main vacuum line that leads to a collector tank and exhauster. Each loom is equipped with a manifold and several small nozzles. The flow of air on each loom is controlled by a small blast gate valve.

The electropneumatic valve opens for ten seconds, for example, providing required suction simultaneously for the fourteen to sixteen looms in the group. A control timer signals each valve in turn until all groups have been cleaned. The amount of air required on each nozzle is approximately four to five cfm. On each loom there is a manifold vacuum which must be no less than five inches Hg. (seventy inches water) complete cleaning of up to six hundred looms can be achieved in 6.33 minutes with an exhauster driven by a fifty horsepower motor. Power consumption on a per loom basis is approximately 0.083 horsepower.

Figures 1, 2:
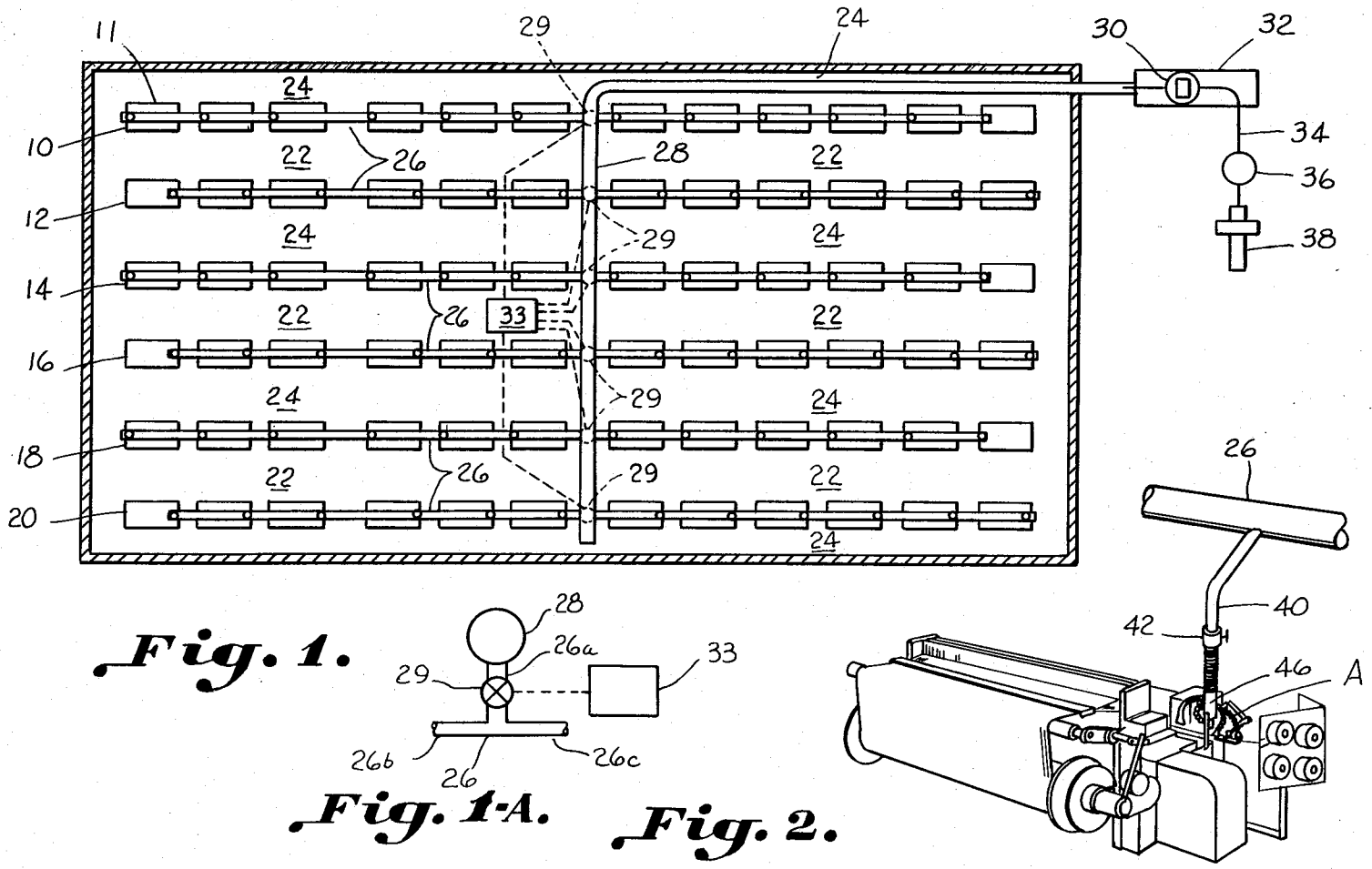
FIG. 1 is a plan view illustrating an installation of the looms arranged in rows for vacuum cleaning in accordance with the present invention.
FIG. 2 is a perspective view of a loom with vacuum cleaning in accordance with the present invention.
Figure 3:
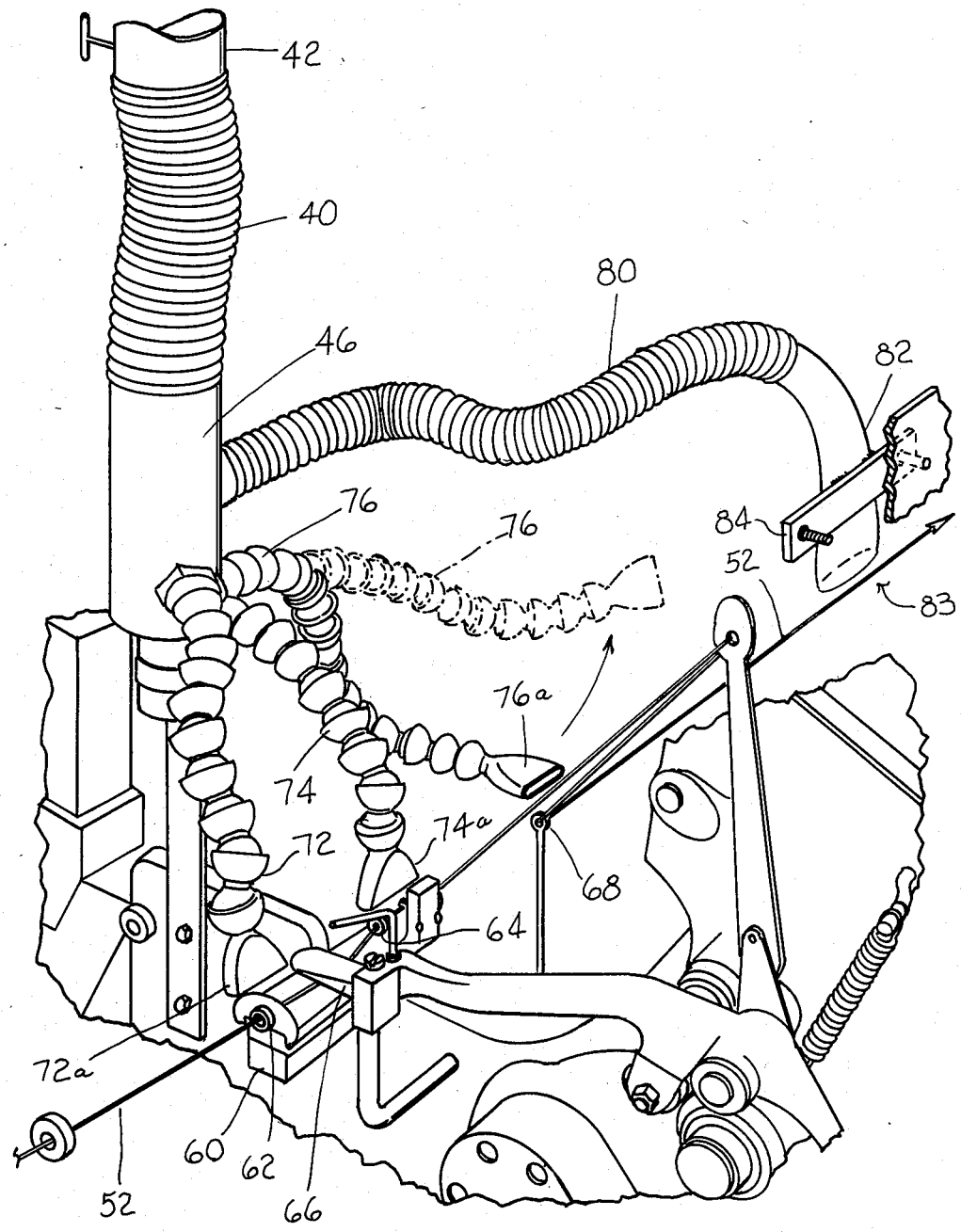
FIG. 3 is an enlarged perspective view of the automatic weft insertion area of a loom vacuum cleaned in accordance with the present invention.
Figure 4:
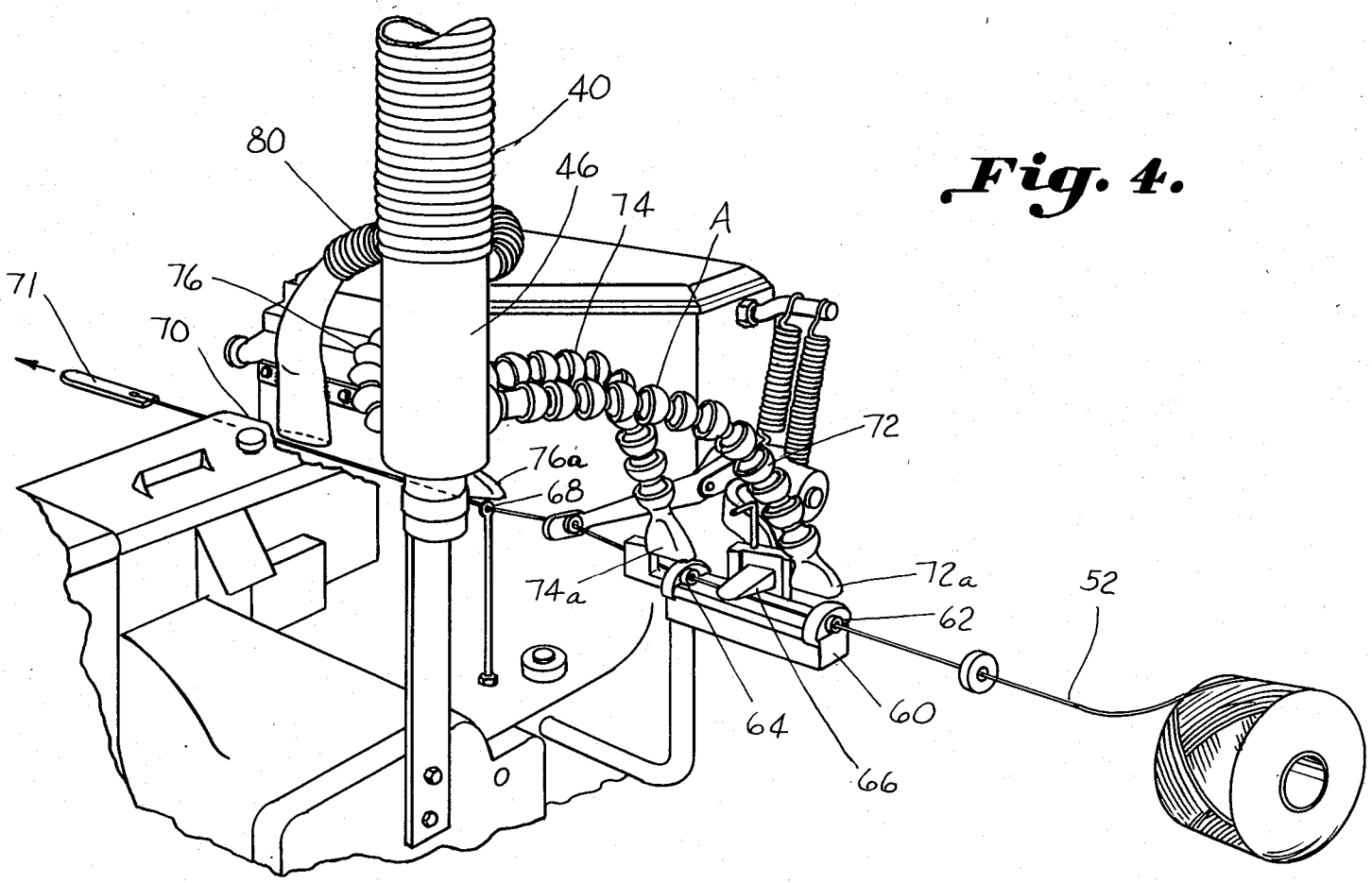
FIG. 4 is an enlarged perspective view illustrating vacuum cleaning of the automatic weft insertion area of a loom in accordance with the invention.

Referring now in more detail to the invention, referring now to FIG. 1, an exemplary floorplan is illustrated wherein rows of weaving machines 10 through 20 are illustrated defining weavers alleys and warp alleys in between in a conventional manner. The warp alleys are illustrated at 22 and the weavers alleys at 24.

Along each row of weaving looms is a secondary vacuum line 26 which are connected to a main vacuum line 28 connected to a automatic dumping receiver 30 which feeds a waste baler 32 in a conventional manner. Supply line 34 passes to an automatic secondary filter 36 and then to a centrifugal vacuum pump 38. The waste in the form of fly and other material moving through vacuum lines 26 and 28 will be deposited in the automatic dumping receiver that dumps automatically into the baler. The baled waste is then either sold or discarded.

A first valve means in the form of an electropneumatic valve 29 is a located in a "T" branch **26*a* of secondary vacuum line 26 defining first and second sections 26*b* and 26*c* of the secondary vacuum line extending to rows on opposing sides of main vacuum line 28**. In this manner, vacuum may be applied in a cyclic way to one row of looms at a time.

Referring now in more detail to the invention, at each loom 11, a branch vacuum line 40 drops downwardly from the secondary vacuum line 26. An underfloor piping arrangement may also be utilized in which case branch vacuum line 40 would rise up from the floor. A second valve means is provided by a balancing gate valve 42 connected in each branch line of each loom which may be any suitable gate valve such as a one and a half inch slide valve manufactured by Valterra Co. of San Fernando, Calif. Gate valve 42 enables the vacuum delivered to each loom to be cut off and on selectively. Moreover, the valve may be advantageously used to balance the vacuum at each loom along each row of looms. In this way, the vacuum at the looms at the outermost ends of the row may be made equal to that of those looms closest to the supply line 28 and each loom receives generally the same amount of vacuum.

Connected to the gate valve is a vacuum manifold 46. The vacuum manifold 46 connects a number of individual loom vacuum lines. The loom vacuum lines include a number of directional vacuum lines A that are flexible for routing to a desired part for vacuuming and cleaning. Directional lines A become rigidly oriented and are self-supporting, once positioned, and no auxiliary suporting structure is needed at the end of the line. The flexible directional vacuum line may be flexed and moved to an optimum position for cleaning the part. The directional line may be moved without the need of dismantling equipment for servicing the part cleaned and repositioned. This is highly advantageous since it is necessary to move the vacuum nozzle out of the way in order to service the part. Suitable flexible directional lines are available from Lockwood Products of Lake Oswego, Oreg. under the designation "Loc-Lite." Such lines comprise ball and socket couplings normally used for liquid coolant delivery. These have been found highly advantageous for conveying air in the present invention without support.

The filling thread 52 coming from a reserve package or thread package enters the loom at a thread tensioning device 60. Typically such a thread tensioning device includes a tension guide 62 on the incoming end and a tension guide 64 on the outgoing end. In between the two tensioning guides is a tensioning member 66 which applies a desired amount of tension to the filling thread. After the thread leaves the tensioning device it passes through a thread guide 68 and from there to a mechanical weft insertion device 70. In the automatic insertion device, the filling thread is grasped, for example, by a projectile 71 and delivered through the shed of the warp threads during weaving. A good deal of lubrication is applied to the working parts of the automatic insertion device 70 due to the mechanical nature of the operation. It is in this area that the oily mist combines with the fly or loose fibers to cause most of the problems to which the present invention is directed.

Referring once again to the thread tensioning device 60 it can be seen that a first directional vacuum line 72 is directed to the tension guide 62 having a nozzle **72*a* disposed approximate to the tension guide for maintaining the same clean. A second directional vacuum line 47 having a nozzle 74*a* is routed to the second tension guide 64 of tensioning device 60. Nozzle 74*a* is disposed adjacent tension guide 64 for maintaining the same clean. A third directional vacuum line 76 is routed to thread guide 68. A nozzle 76*a* is disposed ajdacent the eyelet of thread guide 68 for maintaining the same clean through vacuuming. Preferably nozzles 72*a*, 74*a*, and 76*a*** are divergent nozzles which have been found most effective.

Referring now again to the automatic insertion device 70, it can be seen that a primary loom vacuum line 80 is routed to the mechanical automatic insertion device. In this case however a vacuum nozzle 82 is permanently attached to the automatic insertion device in the thread grasping area 83 and for this purpose a mounting bracket 84 is provided. It is necessary to maintain the inlet opening of the vacuum nozzle closely adjacent the thread and projectile in the thread, grasping area of the automatic insertion device so that the thread is clean when picked up by the projectile or other insertion device.

In operation, the directional loom vacuum lines A are routed to the desired location and fixed by the nature of their coupling which remain rigidly fixed once they are deformed and moved. Primary vacuum line 80 is fixed in place by bracket 84. Vacuum may be balanced by adjusting gate valve 42 so that approximately the same vacuum exists at each loom 11.

Automatic control valve 29 is inserted in the main vacuum line 28 at the junction of each secondary line 26 for the left and right side of a row of looms. Constant vacuum need not be applied to all the looms at the same time. The vacuum system may be operated on an intermittent basis in which case only a selected number of looms may be vacuumed at a given time resulting in a vacuum system reduced in size and horsepower to conserve energy. Typically, the vacuum needs to be applied to the nozzles on a loom for approximately ten seconds every three minutes. However, the cycle times for the vacuum nozzles at each loom may vary depending on the number of looms and the application being made. It has been found that the buildup of oily loose fiber does not accumulate rapidly enough to require constant vacuum on all nozzles at all times.

For this purpose, all automatic control vavles 29 are controlled by conventional programmable controller or timer 33, such as a conventional microprocessor whose programing and provision is well within the skill of the average artistan, to cycle that row of looms on or off at the desired time.

For example, on the installation of two hundred looms, vacuum may be applied to twenty looms for ten seconds. Then the vacuum is applied to twenty looms on the next nine rows of looms, one row at a time. It is evident that the first row of twenty looms is alloted vacuum for ten seconds and then is shut off while the vacuum then is alloted to nine other rows ten seconds at a time and rotated back to the first rows ninety seconds later.

It has been found that this system reduces defects caused by oily loose fly being woven into the fabric by at least sixty to ninety percent. If the system is sized correctly, vacuum can also be supplied to a vacuum hose connecting valves to connect a vacuum hose to clean the other areas of the loom manually.

While a preferred embodiment of the invention has been described using specific terms, such description is for illustrative purposes only, and it is to be understood that changes and variations may be made without departing from the spirit or scope of the following claims.

What is claimed is:

1. A system for cleaning the automatic weft insertion area of a loom wherein a number of looms are arranged in successive rows, said system comprising:

a vacuum source;

a main vacuum line connected to said vacuum source;

a plurality of secondary vacuum lines connected to said main vacuum line extending along said rows of looms;

a branch vacuum line connected to said secondary vacuum lines extending to one of said looms;

a vacuum manifold connected to each said branch vacuum line;

a number of loom vacuum lines connected to said manifold extending to specific parts located at said automatic weft insertion area for removing loose fly and fibers from said parts by vacuum and transporting said fly and fibers away from said loom for disposal at a remote location;

valve means connected between said main vacuum line and said secondary vacuum lines for operatively connecting and disconnecting said secondary vacuum lines with said main vacuum line; and timing means for opening and closing said valve means in prescribed intervals to intermittently apply vacuum to each said loom in a cyclic manner.

2. The system of claim 1 wherein said secondary vacuum line comprises a "T" connector line in which said valve means is disposed.

3. The system of claim 2 wherein each secondary line extends transverse to said "T" connector line to define a first secondary vacuum line on one side of said main vacuum line and a secondary vacuum line on the opposing side of said main vacuum line to service rows of looms on opposing sides of said main vacuum line.

4. The system of claim 1 wherein said loom vacuum lines include flexible, directional vacuum lines which may be flexed to a desired, fixed configuration without external support at a free end of said directional vacuum line in a manner that each directional vacuum line may be disposed adjacent a vacuuming location and moved from that location manually and reset in an approximate vacuuming position with respect to that location.

5. The system of claim 4 wherein said directional vacuum lines consist of ball and socket couplings connected together wherein each said ball and socket moves omnidirectional with respect to each other.

6. The system of claim 4 wherein each said directional vacuum line terminates in a vacuum nozzle for being disposed closely adjacent the part location to be vacuumed wherein said nozzle comprises a divergent nozzle.

7. The system of claim 1 wherein said loom vacuum lines include a primary vacuum line extending to a mechanical weft insertion device in said automatic weft insertion area.

8. The system of claim 7 wherein said loom vacuum lines further include a number of flexible directional vacuum lines which may be flexed and moved to a desired vacuuming location, said vacuuming locations of said directional vacuum lines including thread guides and thread tensioning guides through which said weft thread passes in route to said mechanical weft insertion device.

9. The system of claim 1 wherein said timing means cycles each secondary vacuum line and each loom located on said secondary vacuum line a prescribed number of seconds per cycle.

10. The system of claim 1 including a second valve means disposed in a number of said branch vacuum lines between said secondary vacuum line and said manifold for balancing the vacuum at respective looms to compensate for the distance of the loom from the main vacuum line in a manner that generally equal vacuum is applied to all of the looms in a row to which said secondary vacuum line services.

11. Apparatus for vacuum cleaning prescribed parts and locations on a loom having vacuum lines routed to the loom comprising:

a branch vacuum line extending from said vacuum line to said loom;

a vacuum manifold connected in said branch vacuum line;

means for mounting said manifold adjacent said loom;

a plurality of loom vacuum lines connected to said manifold vacuum line extending to prescribed locations of said loom for vacuuming and cleaning said locations;

a number of said loom vacuum lines comprising a flexible, directional vacuum line being flexible and movable in a manner that a free end of said directional vacuum line may be fixed and moved to a desired position at one of said part locations without external attachment at said location, said directional line may be flexed and moved away from said location for servicing said part without detechment, and thereafter reset at said location by flexing and returning said directional vacuum line without attachment.

12. The apparatus of claim 11 wherein said loom vacuum lines include a primary loom vacuum line having a larger vacuuming capacity than said directional vacuum lines connected to said manifold.

13. The apparatus of claim 12 wherein said directional vacuum lines are positioned at various thread guides and thread tensioning guides of automatic weft insertion area of the loom and said primary vacuum line is positioned at the mechanical weft insertion device of said automatic weft insertion area.

14. The apparatus of claim 11 where each said directional vacuum line comprises a number of ball and socket couplings connected together to form a prescribed length of directional vacuum line, said ball and socket couplngs providing omnidirectional flexing of said directional lines in all directions while retaining said line rigidly fixed when moved to a desired vacuuming location.

15. The apparatus of claim 11 wherein said directional vacuum lines consist of omnidirectional coupling means fastened together so that said directional vacuum lines may be move in all directions and adjusted to a rigid position.

16. The apparatus of claim 11 where each said directional vacuum line terminates in a divergent vacuuming nozzle.

17. The apparatus of claim 11 including a balancing gate valve disposed in said branch vacuuming lines between said manifold and said vacuum line being operatable to balance the vacuum between looms arranged in a row along said secondary vacuum line so that generally equal pressure may be applied to each said loom in said row.

18. A method of cleaning an installation of looms by applying a vacuum to various areas of each loom comprising the steps of:

providing a vacuum line connected to a source of vacuum;

providing a number of branch vacuum line connected to said vacuum line and to said looms;

providing a number of loom vacuum lines extending from said branch vacuum line to various locations on the loom to be cleaned;

providing a number of said loom vacuum lines in the form of flexible directional vacuum lines having free ends which may be flexed and moved to a desired position at a vacuuming location and set at that position without external support of said free end to said loom in a manner that said vacuum line may be moved from said position and repositioned without detachment and reattachment.

19. The method of claim 18 wherein said method includes providing in said loom vacuum lines a primary loom vacuum line having larger flow capacity than said directional vacuum lines.

20. The method of claim 19 including positioning said directional vacuum lines at thread guides and thread tensioning guides at an automatic weft insertion area of said loom.

21. The method of claim 20 positioning said primary loom vacuum line at the mechanical insertion device in said automatic weft insertion area.

22. A method of cleaning various parts on a loom by utilizing a vacuum, said looms being arranged in rows with a number of successive rows at an installation, said method comprises the steps:

providing a vacuum line along each row of looms;

providing a branch vacuum line from said vacuum line to each said loom;

providing a number of loom vacuum lines extending from said branch vacuum line to various locations of the loom for removing fly and the like from said locations and away from said loom by vacuum;

placing an operative vacuum in each vacuum line along each row of looms in an intermittent manner such that each loom in said row receives a vacuum for prescribed interval of time and then no longer receives the vacuum; and applying said intermittent vacuum to successive rows of said looms in a cyclic manner until all looms have been cleaned and thereafter repeating said cycle of vacuuming the looms in a row intermittently.

23. The method of claim 22 comprising balancing the vacuum at each loom along each row so that looms along the row are provided with substantially equal vacuum.

24. The method of claim 23 including providing a number of said loom vacuum lines in the form of flexible directional lines having free ends which may be flexed to move to a desired position at a desired vacuuming location and thereafter set in place without external support at said location.

* * * * *